US005209901A

United States Patent [19]

Reifferscheid et al.

[11] Patent Number: 5,209,901

[45] Date of Patent: May 11, 1993

[54] AGENT FOR THE TREATMENT OF CAST IRON MELTS

[75] Inventors: Karl-Josef Reifferscheid, Karben, Fed. Rep. of Germany; Dieter H. Gumbinger, Marietta, Ga.

[73] Assignee: SKW Trostberg AG, Trostberg, Fed. Rep. of Germany

[21] Appl. No.: 861,575

[22] Filed: Apr. 1, 1992

[30] Foreign Application Priority Data

Jul. 20, 1991 [DE] Fed. Rep. of Germany ..... 4124159

[51] Int. Cl.[5] ..... C22C 29/00; C22C 35/00

[52] U.S. Cl. ..... 420/578

[58] Field of Search ..... 420/578

[56] References Cited

U.S. PATENT DOCUMENTS 3,383,202 5/1968 Lynch ..... 420/578

*Primary Examiner*—Peter D. Rosenberg

*Attorney, Agent, or Firm*—Felfe & Lynch

[57] ABSTRACT

Disclosed is an agent based on ferrosilicon for the treatment of cast iron melts before treatment with spheroidal graphite-inducing elements, especially magnesium, wherein, as additive elements, the agent additionally contains calcium, aluminum, manganese, zirconium, cerium and lanthanum. The content of iron plus silicon is at least 75% by weight with reference to the weight of all components and the elements zirconium, cerium and manganese additively are at least 5% by weight of the agent. The present invention also provides a process for the production of this agent, as well as a process for treating cast iron melts therewith.

21 Claims, No Drawings

AGENT FOR THE TREATMENT OF CAST IRON MELTS

BACKGROUND OF INVENTION

The present invention is in an agent based on ferrosilicon for the treatment of cast iron melts which are subsequently passed on to a further treatment with spheroidal graphite-inducing elements, especially magnesium.

The structure of cast iron with spheroidal graphite is dependent to a large extent on the nature of the added materials, the carrying out of the melting (overheating temperature and time), the treatment with spheroidal graphite-inducing elements, especially magnesium, and possibly to an after-inoculation.

Numerous publications have addressed the subject of achieving optimum structures by the treatment of cast iron melts. For example, EP-PS 0 175 934 is concerned with an inoculation alloying on the basis of ferrosilicon or silicon with contents of 0.1 to 10% by weight of barium and/or zirconium, less than 2.0% by weight of aluminium and less than 0.3% by weight of calcium. DE-OS 38 09 315, describes a similar alloy, the barium content of which can, however, vary between 0.1 and 15% by weight and which, instead of zirconium, contains from 0.1 to 10% by weight of strontium, as well as less than 2% by weight of aluminium and less than 2.5% by weight of calcium. EP 0 353 804 A1 discloses a process for the production of cast iron with spheroidal graphite by the treatment of cast iron melts with an agent containing magnesium or magnesium and rare earth metals in which the components contained therein correspond to the ratio of the alloy components in the cast iron alloy to be treated. Furthermore, in DE-OS 39 32 162, there is disclosed an agent for the production of spheroidal graphite iron based on magnesium silicide. Finally, it has already been recommended to improve the nucleus state of cast iron melts before the magnesium treatment by the addition of a graphitic inoculation agent (see Giesserei-Praxis, 7, 120–124/1991; C. R. Loper, Jr., B. Y. Hus and T. H. Witter).

However, all the above-mentioned agents have, in particular, the disadvantage that their pre-inoculation effect is relatively small so that a relatively high use of alloy is necessary in order to achieve the desired effect.

Therefore, it is an object of the present invention to provide an agent for the treatment of a cast iron melt which substantially improves the nucleus state of the base melt so as to provide favourable prerequisites for the subsequent treatment with spheroidal graphite-inducing elements.

It is also an object of the present invention to provide an agent which can be introduced into the cast iron melt in a simple manner. It is a further object of the invention to provide an agent which can be dissolved rapidly in the iron melt without slag formation. Another object of the present invention is to provide an agent which can be dispersed uniformly in the melt.

It is yet another object to provide an agent which forms thermodynamically stable substrates, for example $Ce_2O_3$ or $Ce_2O_2S$, which remain as nuclei for the crystallisation of the graphite in the melt also during subsequent treatment steps, especially with magnesium.

THE INVENTION

The present invention is in an agent based on ferrosilicon for the treatment of cast iron melts before treatment with spheroidal graphite-inducing elements, especially magnesium. The agent additionally contains, as additive elements, calcium, aluminium, manganese, zirconium, cerium and lanthanum, the content of iron plus silicon of the agent at least 75% by weight with reference to the weight of all components, The sum of the elements zirconium, cerium and manganese do not go is at least 5% by weight.

The agent according to the present invention preferably contains from 55 to 75% by weight of silicon.

The agent according to in a preferred embodiment, the present invention has the following composition:

| | |
|---|---|
| silicon | 58–70% by weight; |
| calcium | 0.5–1.8% by weight; |
| aluminium | 0.5–1.8% by weight; |
| manganese | 2.5–7.0% by weight; |
| zirconium | 1.0–7.0% by weight; |
| cerium | 1.0–3.0% by weight; |
| lanthanum | 0.5–1.5% by weight; |
| iron | remainder. |

An especially preferred composition of the agent is the following:

| | |
|---|---|
| silicon | 62–67% by weight; |
| calcium | 0.8–1.2% by weight; |
| aluminium | 0.8–1.2% by weight; |
| manganese | 3.5–5.0% by weight; |
| zirconium | 3.5–5.0% by weight; |
| cerium | 1.8–2.2% by weight; |
| lanthanum | 0.1–0.2% by weight; |
| iron | remainder. |

The addition of a small amount of an agent of the above-given composition brings about a substantial improvement of the cast structure and provides decisive advantages for the user of the cast pieces.

The agent of the present invention can, be introduced into the cast iron melt as a ready-made "pre-alloy" alternatively the individual components of the agent can be added to the cast iron melt in the form of a non-alloyed or partly alloyed mixture.

The production of a pre-alloy of the individual components of the agent according to the present invention preferably takes place either in a submerged arc furnance by the addition of the necessary amounts of oxides or ores to a ferrosilicon melt and subsequent reduction or in a high-frequency furnace by the alloying-in of the elements to a ferrosilicon melt present therein.

The agent of the present invention is preferably used in fine-grain form with a grain size of 0.1 to 5 mm, preferably of 0.2 to 3 mm and especially preferably of 0.4 to 2.0 mm. The agent can be introduced into the cast iron melt by means of the usual dosing devices. It is also possible to dose in the agent according to the present invention, in the case of pouring the melt from the furnace into the ladle, into the casting stream mechanically or manually. The agent can be introduced into the cast iron melt in a preferable manner in the form of a filled wire.

It is important that the addition of the agent according to the present invention takes place immediately, i.e. at most 5 minutes, before the treatment with spheroidal graphite-inducing elements Preferably, the graphite inducing element is a magnesium-containing alloy or mixture, for example ferrosilicon-magnesium with contents of 55% by weight of silicon and 31% by weight of magnesium, as well as small amounts of calcium and aluminium, or with a nickel-magnesium alloy with 55% by weight of nickel, 5.5% by weight magnesium and up to 1% by weight of silicon, the remainder being iron. During the addition of the pretreatment agent according to the present invention, the temperature of the melt is perferably from 1400° to 1550° C. and more, preferably from 1430° to 1530° C.

The added amount of the pre-treatment agent according to the present invention depends upon the dissolved content of oxygen and sulphur in the melt to be treated, as well as upon the content of trace elements, for example lead, bismuth, arsenic, antimony and titanium. Depending upon the chemical composition of the melt, there are added 1 to 5 kg, and preferably 1 to 2.5 kg of the pre-alloy according to the present to 1000 kg of melt invention so that, in the melt, there remain 20 to 100 or 20 to 50 ppm of cerium and 20 to 100 or 20 to 50 ppm of zirconium.

The addition of the pre-treatment agent according to the present invention can replace, or preferably, supplement the graphitic treatment agents usually added previously to a melt in the form of synthetic or natural graphite, coke and/or graphited coke. The alloy according to the present invention and the graphitic treatment agent are preferably added in a weight ratio of 1:0.1 to 1 and more preferably of about 1:1.

By means of the addition of the given amount of the pre-treatment agent according to the present invention, there is achieved a practically complete nodularisation of the carbon present. Furthermore, the formation of the spheroidal graphite in the cast piece takes place very uniformly distributed in spheroids of substantially uniform size.

Finally, the carbide formation is substantially reduced. Such features result in cast pieces of good workability and represent decisive advantages for the user.

The following Example is given for the purpose of illustrating the present invention:

EXAMPLE

In an acid-adjusted mains supply induction crucible furnace of 3 t nominal capacity was melted a base melt of manganese-poor crude iron, characteristic recycled and deep-drawn steel scrap with the addition of electrode graphite as carbonising agent and particulate ferrosilicon containing 75% by weight of silicon as siliconising agent, the base melt containing, in addition to iron, the following elements in the given amounts expressed as weight percent:

| | | | | | |
|---|---|---|---|---|---|
| carbon | 3.64 | silicon | 2.12 | manganese | 0.16 |
| phosphorus | 0.018 | titanium | 0.011 | chromium | 0.03 |
| nickel | 0.05 | copper | 0.15 | sulphur | 0.011 |
| cerium | n.n.+ | zirconium | n.n.+ | | |

n.n.+ = below the limit of detection of 0.0020%

Melt samples a), b), c) and, d) each of 100, kg were tapped off at a temperature of the melt in the furnace of 1460°±6° C. In the case of the tapping off into preheated ladles, there took place the pre-inoculation in the casting stream by the continuous addition of a) 0.1% by weight of a commercially available graphitic inoculation agent with a grain size of 0.2 to 0.1 mm (for example synthetic graphitic carbon (Desulco))

b) 0.1% by weight of a pre-treatment agent according to the present invention in the form of an alloy with the grain size of 0.4 to 2.0 mm and c) 0.1% by weight of a pre-treatment agent according to the present invention in the form of an alloy with the grain size of 0.21 to 0.63 mm into the casting stream.

Immediately thereafter, there took place the treatment with spheroidal graphite-inducing elements, especially magnesium, for example with the previously mentioned nickel-magnesium alloy with a content of 55% by weight of nickel, 5.5% by weight of magnesium and up to 1% by weight of silicon, the remainder being iron, in an amount of 1% by weight, referred to the treatment amount of 100 kg. In this way, residual magnesium contents of 0.035 to 0.40% by weight were adjusted.

For the comparison of the assessment of the nucleus state of the melt, at the beginning and end of the experiment, no pre-inoculation was carried out on each of a melt of 100 kg (sample d).

The pre-treatment agent used according to the present invention had the following composition, the parts being expressed as weight percent:

| | | | | | |
|---|---|---|---|---|---|
| silicon | 62.0 | calcium | 1.08 | aluminium | 1.05 |
| manganese | 4.2 | zirconium | 3.9 | cerium | 2.0 |
| lanthanum | 0.18 | remainder iron | | | |

In all treatments, the temperature was in the range of from 1411° to 1426° C. After tapping off of the reaction slag, from each of the melts a) to d) was tapped off, without after-inoculation, $Y_2$ samples (DIN 1693) and subsequently investigated metallographically. An after-inoculation, for example with FeSi 75, was deliberately omitted in order to make clear the effect of the pre-inoculation.

The metallographic investigation of the samples refers to the determination of the nodularity, of the sphere number, as well as of the micrograph images which are evaluated microscopically. The technique for precise carrying out these methods is conventional for one of ordinary skill in the art.

The metallographic results of these experiments are shown in the following Table:

| sample | No. | pre-inoculation | Nodularity % | sphere number/ $mm^2$ in $Y_2$ sample | base mass % perlite | % ferrite | % cementite |
|---|---|---|---|---|---|---|---|
| a | 1 | 0.1% graphite | 100 | 130 | 80 | 20 | tracer |
| | 2 | 0.1% graphite | 100 | 145 | 80 | 20 | 0 |
| | 3 | 0.1% graphite | 100 | 145 | 75 | 25 | 0 |
| b | 1 | 0.1% alloy | 100 | 210 | 70 | 30 | 0 |
| | 2 | (0.4 to 2 mm) | 100 | 195 | 70 | 30 | 0 |
| | 3 | (0.4 to 2 mm) | | 222 | 65 | 35 | 0 |
| c | 1 | 0.1% alloy | 100 | 216 | 65 | 35 | 0 |
| | 2 | (0.21 to 0.63 mm) | 100 | 205 | 70 | 30 | 0 |
| | 3 | (0.21 to 0.63 mm) | 100 | 204 | 70 | 30 | 0 |
| d | A | — | 95 | 95 | 85 | 15 | 5 to 10 |
| | E | — | 90 | 81 | 90 | 10 | 10 |

The melts treated with alloys according to the present invention, hardened to white samples, gave the following analytical values in percent by weight:

| sample | C | Si | Mn | P | Ti | Cr | Ni | Cu | S | Ce | Zr |
|---|---|---|---|---|---|---|---|---|---|---|---|
| b) 1 | 3.56 | 2.09 | 0.15 | 0.018 | 0.011 | 0.03 | 0.05 | 0.14 | 0.011 | 0.0040 | 0.0040 |
| 2 | 3.58 | 2.04 | 0.15 | 0.016 | 0.011 | 0.03 | 0.04 | 0.15 | 0.009 | 0.0035 | 0.0040 |
| 3 | 3.55 | 2.04 | 0.15 | 0.016 | 0.011 | 0.03 | 0.05 | 0.15 | 0.009 | 0.0039 | 0.0040 |
| c) 1 | 3.51 | 2.06 | 0.15 | 0.018 | 0.014 | 0.03 | 0.05 | 0.15 | 0.010 | 0.0041 | 0.0040 |
| 2 | 3.51 | 2.01 | 0.15 | 0.018 | 0.010 | 0.03 | 0.04 | 0.15 | 0.010 | 0.0039 | 0.0040 |
| 3 | 3.54 | 2.06 | 0.15 | 0.017 | 0.010 | 0.03 | 0.04 | 0.15 | 0.011 | 0.0043 | 0.0040 |

The contents of cerium and zirconium determined in the analysis samples demonstrate that a uniform distribution of these elements was obtained, which led to a substantial improvement of the nucleus state of the melts.

It will be understood that the specification and examples are illustrative but not limitative of the present invention and that other embodiments within the spirit and scope of the invention will suggest themselves to those skilled in the art.

We claim:

1. An agent for the treatment of cast iron melts before the treatment with spheroidal graphite-inducing elements, comprising: ferrosilicon, calcium, aluminum, manganese, zirconium, cerium and lanthanum, wherein the content of iron plus silicon of the agent is at least 75 wt.-% with reference to the weight of all components and the elements zirconium, cerium and manganese additively constitute at least 5 wt.-%.

2. The agent of claim 1 consisting essentially of:

| | |
|---|---|
| silicon | 58–70% by weight; |
| calcium | 0.5–1.8% by weight; |
| aluminum | 0.5–1.8% by weight; |
| manganese | 2.5–7.0% by weight; |
| zirconium | 1.0–7.0% by weight; |
| cerium | 1.0–3.0% by weight; |
| lanthanum | 0.5–1.5% by weight; |

the remainder being iron and usual impurities.

3. The agent of claim 2 of the following composition:

| | |
|---|---|
| silicon | 62–67% by weight; |
| calcium | 0.8–1.2% by weight; |
| aluminum | 0.8–1.2% by weight; |
| manganese | 3.5–5.0% by weight; |
| zirconium | 3.5–5.0% by weight; |
| cerium | 1.8–2.2% by weight; |
| lanthanum | 0.1–0.2% by weight; |

the remainder being iron and usual impurities.

4. The agent of claim 1 having a grain size of from 0.1 to 5 mm.

5. The agent of claim 1 having a grain size of 0.4 to 2 mm.

6. The agent of claim 1 having a grain size of from 0.2 to 3 mm.

7. The agent of claim 1 as a filling material in a filled wire.

8. The agent of claim 1 as an alloy of the appropriate additive elements.

9. A process for the production of an alloy according to claim 1 comprising adding the respective amounts of oxides of the additive elements to a ferrosilicon melt.

10. The process of claim 9 wherein the ferrosilicon melt is in a submerged arc furnace.

11. The process of claim 9 wherein the ferrosilicon melt is in a high frequency furnace.

12. The agent of claim 1, produced by the process according to claim 9.

13. A process for the treatment of a cast iron melt comprising: forming a cast iron melt; introducing into the melt an agent according to claim 1; and, adding a spheroidal graphite-inducing element into the melt immediately after introducing the agent.

14. The process of claim 13 wherein the spheroidal graphite-inducing element contains magnesium in the form of an alloy or of a mixture.

15. The process of claim 13 wherein 1 to 5 kg of the agent are added per 1000 kg of melt.

16. The process of claim 13 wherein 1 to 2.5 kg of the agent are added per 1000 kg of melt.

17. The process of claim 13 wherein a graphitic inoculation agent is added to the melt before the treatment with the agent based on ferrosilicon.

18. The process of claim 17 wherein the graphitic inoculation agent is at least one of synthetic graphite, natural graphite, coke and graphited coke.

19. The process of claim 13 wherein the agent is introduced as a pre-alloy.

20. A cast iron melt treated by the process of claim 13.

21. A process for the production of an alloy according to claim 1 comprising adding the respective amounts of ores of the additive elements to a ferrosilicon melt.

* * * * *

UNITED STATES PATENT AND TRADEMARK OFFICE

CERTIFICATE OF CORRECTION

PATENT NO. : 5,209,901

DATED : May 11, 1993

INVENTOR(S) : Karl-Josef Reifferscheid et al

It is certified that error appears in the above-indentified patent and that said Letters Patent is hereby corrected as shown below:

Col. 2, line 5, "," should be --.--.

Col. 2, line 10, "The agent according to in a preferred embodiment," should read --In a preferred embodiment, the agent according to--.

Col. 2, line 39, delete ",".

Col. 2, line 39, after "pre-alloy" insert --.--.

Col. 2, line 40, "alternatively" should read --Alternatively--.

Col. 3, line 31, after "place" insert --in--.

Col. 3, line 32, delete "in".

Signed and Sealed this

Twenty-sixth Day of July, 1994

Bruce Lehman

*Attest:*

BRUCE LEHMAN

*Attesting Officer*

*Commissioner of Patents and Trademarks*